US005643180A

United States Patent [19]

McIlwain

[11] Patent Number: 5,643,180

[45] Date of Patent: Jul. 1, 1997

[54] PASSIVE BODY-MOTION GENERATING, APPARATUS AND PROCEDURE

[76] Inventor: William A. McIlwain, 7 S. Briarcliff Rd., Bristol, Tenn. 37620

[21] Appl. No.: 373,473

[22] Filed: Jan. 17, 1995

Related U.S. Application Data

[63] Continuation of Ser. No. 977,820, Nov. 17, 1992, abandoned.

[51] Int. Cl.[6] ..... A61H 1/00

[52] U.S. Cl. ..... 601/24; 601/26; 606/242

[58] Field of Search ..... 606/241–245; 601/23, 24, 26; 5/616, 618, 619

[56] References Cited

U.S. PATENT DOCUMENTS

| | | | |
|---|---|---|---|
| 1,400,546 | 12/1921 | Holme | 606/245 |
| 2,494,746 | 1/1950 | Colston | 601/26 |
| 2,548,408 | 4/1951 | Tammen | 128/25 R |
| 2,749,911 | 6/1956 | Griffin | 606/242 |
| 3,060,926 | 10/1962 | May | 128/25 R |
| 3,620,210 | 11/1971 | Annas et al. | 128/25 R |
| 4,101,120 | 7/1978 | Seshima | 5/616 |
| 4,953,541 | 9/1990 | Parker, Jr. | 128/25 R |
| 5,035,234 | 7/1991 | Forsythe | 128/25 R |

*Primary Examiner*—Richard J. Apley
*Assistant Examiner*—Jeanne M. Clark

[57] ABSTRACT

A passive body-motion generating device particularly adapted for moving a leg through natural or representative hip joint articulation, the device having body support structure, at least one leg support member having a proximal end, a distal end and a longitudinal rest axis, a hinge mechanism connecting the proximal end of the member to the body support structure, the hinge mechanism having a first pivotal axis providing generally vertical rotation for the member and a second pivotal axis providing generally lateral rotation for the member, these axes being oriented at substantially right angles to each other, and at least one motor associated with the hinge mechanism for rotating the same and the member about each of the two axes of rotation either simultaneously or in tandem, the tandem rotation being operative to selectively describe a plane or a curved surface with the member.

9 Claims, 5 Drawing Sheets

PASSIVE BODY-MOTION GENERATING, APPARATUS AND PROCEDURE

This application is a continuation of application 07/977,820, filed Nov. 17, 1992, now abandoned.

FIELD OF INVENTION

The present invention concerns therapeutic, passive body-motion generating devices and therapeutic motion procedure, particularly those devices and procedures which are used for body rehabilitation purposes, especially for soft tissue repair, and which require little or no physical effort of the patient for producing the motion.

Patients who have experienced impact, twist, dislocation or other damage to soft tissue such as tendons or ligaments of a joint, or who have undergone surgery with respect thereto, especially of the hip, are typically required, or at least advised, to essentially immobilize the lower body by maintaining a prone or near prone position for extended periods of time. In many cases however it has been recognized that some, even though slight motion of the damaged and/or adjacent areas of the hip during recovery or rehabilitation has beneficial effects, for example, in enhancing blood flow to the area, in helping to maintain muscle strength and tone, in helping to properly orient and enhance the development, strengthening and mobility of scar tissue fibrils, and in maintaining a general feeling of activity and well-being in the patient.

BACKGROUND OF THE INVENTION

The healing of soft tissue injuries has been shown to occur by fibrous repair, i.e., scar tissue generation of the damaged tissue, and such repair may be seen at as comprising three phases; (1) acute inflammatory or reaction phase, (2) repair or regeneration phase, and (3) remodelling phase.

(1) Acute Inflammatory or Reaction Phase

This phase may last up to 72 hours depending upon severity of the injury or the extent of the surgery. It is usually a combination of cellular and humoral responses that are interacting with each other. The classic signs of acute injury and the inflammatory response include swelling, redness, warmth, and pain.

Conventional treatments of acute soft tissue injuries have included rest, cryotherapy, and the use of anti-prostaglandin medications during the first 48 to 72 hours following injury. Since the intensity of the inflammatory response to trauma leads to secondary effects that impair mobility, the immediate endeavor is inhibit inflammation to the greatest degree possible, so as to facilitate early movement.

(2) Repair or Regeneration Phase

The repair or regeneration phase is characterized by the synthesis and deposition of collagen which may last from 72 hours up to 8 weeks. This phase is largely one of increasing the quantity of collagen. Cellular debris is removed by granulocytes and macrophages in order for capillaries to form to bring oxygen and nutrients into the damaged area. The oxygen and nutrients activate the fibroblasts which manufacture and secrete collagen.

The new collagen laid down for repair is always in an irregular pattern, different from that of the original tissue and is not fully oriented in the direction of tensil strength. Healing is considered to be by the formation of scar tissue which is less elastic and less functional than normal tissue.

The general concerns on the mechanics of scar tissue formation is that external mechanical factors are involved in the development and orientation of the fibrillary network into orderly layers. The fibrils first develop at random, but then assume definite arrangements, apparently as a direct result of the mechanical factors. Of these factors, movement is no doubt the most important as well as being most effective and least likely to cause pain before the fibrils have developed an abnormal firm attachment to neighboring structures or tissue. When free mobility is present from the onset, the fibers in the scar are arranged lengthwise as in a normal ligament. Gentle passive movements do not detach fibrils from their proper formation at the healing breach but prevent their continued adherence at abnormal sites. The fact that the fibrils rapidly spread in all directions provides sufficient reason for beginning movements at the earliest possible moment, otherwise they develop into the strong fibrous scar adhesions that so often cause prolonged disability.

(3) Remodelling Phase

The tissues next undergo remodelling which may last from three weeks to twelve months or more depending upon the amount of tissue disruption. This phase is a period in which collagen is remodelled to increase the functional capabilities of the tissue to withstand the stresses imposed on it. The remodelling phase merges with the latter part of the regeneration phase, and motion of the injured tissues will influence their structure when they are healed. Tensile strength of the collagen is quite specific to the forces imposed on it and tension within the granulation tissue lines the cells up along the direction of stress. During the healing of mobile tissues, excessive immobilization is harmful in that it prevents the formation of a scar strong in the important direction by avoiding the strains leading to proper orientation of fibrous tissue, and also by allowing the scar to become unduly adherent, e.g., to bone. If there is complete immobilization during the recovery process, the tissue may emerge fully healed but poorly adapted functionally, with little chance for change, particularly if the immobilization has been prolonged.

Many advantages to the soft tissue structures have been shown from early mobilization:

1) Minimized muscle wasting and loss of strength;
2) Less bone and ligament decrement, which may mean a lesser incidence of recurrence of injury;
3) The strength of repaired ligaments is proportional to the mobility of the ligament and contains both larger diameter collagen fiber bundles and more total collagen;
4) Any adhesions that develop will be flexible and will thus allow the tissues to move easily on each other;
5) Early minimal mechanical loading of ligaments enhances strength;
6) Early minimal tensil loading of muscle, tendon, and ligament stimulates collagen fiber growth and alignment;
7) Minimized formation of adhesions between repairing tissues and adjacent structures;
8) Joint proprioception is maintained or develops earlier after injury and this may be important in preventing recurrences of injuries and in hastening full recovery to competitive fitness; and
9) The nutrition of cartilage, which depends on intermittent pressure is better maintained when early mobilization is possible.

DISCUSSION OF THE PRIOR ART

Many devices and apparatus for imparting motion to various parts of the body have been devised and include those shown in U.S. Pat. Nos. 3,894,534; 4,723,537; 4,802,462; 4,827,913; 3.039,456; 3,060,926; and 3,071,130, the general disclosures of utility and structure such as various alternative drive or power means, bases or supporting frames, mechanical linkages for the drive means, body support means, cushioned body support pads or platforms, electrical control systems, or the like contained therein being incorporated herein by reference.

These prior art devices are no doubt therapeutically effective for the specific situations for which are designed, however, none of them relate to the necessities of the presently discussed rehabilitative or treatment problems and procedures particularly associated with hip injuries, hip restoration, or the like requiring actual and representative joint articulation exercise. For example, the passive motion chairs or tables of the above U.S. Pat. Nos. 3,039,456; 3,071,130; and 3,060,926, which applicant believes to be the most relevant prior art, are adapted to move the hip joint in a planar manner which does not represent actual or truly representative joint articulation as experienced in the myriad of hip motion ocurring in every day life. In the absence of true joint articulation, less than complete realization of the salutary effects of the hip exercise is experienced, e.g., the aforementioned proper development of desirable scar tissue of proper orientation and mass is retarded.

Objects, therefore, of the present invention are: to provide a passive body-motion device or apparatus which can lightly and controllably articulate lower regions of the body, particularly the hip joint, in a substantially actual or realistic manner, to impart the salutary effects of natural motion to the impaired body region; to provide such apparatus with motion degree and type adjustability and patient accessibility to drive control mechanisms; and to provide such apparatus with structural compactness and simplicity of construction and operation.

BRIEF SUMMARY OF THE INVENTION

The above and other objects hereinafter becoming evident have been attained in accordance with the present invention which in its apparatus embodiment is defined in its broad sense as a passive body-motion generating device particularly adapted for moving a leg through natural hip joint articulation, comprising body support means, at least one leg support means having a proximal end, a distal end and a longitudinal rest axis, hinge means connecting the proximal end of said leg support means to said body support means, said hinge means having generally vertical axis of rotation and a generally lateral axes of rotation oriented at substantially right angles to each other, and first and second power means for rotating said hinge means independently about each of said two axes of rotation respectively either one at a time or in tandem, the tandem rotation being operative to selectively describe a plane or a curved surface with said leg support means.

In certain preferred embodiments:

(a) said first power means is part of said hinge means and comprises first motor means on said hinge means having first drive shaft means connected to linkage means which is pivotally connected to said leg support means, said second power means comprises second motor means on said body support means having second drive shaft means provided with first gear means, said hinge means having hinge pin means pivotally mounted on said body support means to provide said lateral axis of rotation, said hinge pin means being pivotally connected to said linkage means to provide said vertical axis of rotation, and second gear means on said hinge pin means engaging said first gear means for rotating said hinge pin means by said second motor means;

(b) said first and second gear means comprise cooperating worm gear components;

(c) said first drive shaft means comprises crankpin means;

(d) said linkage means comprises cooperating worm gear components on each of said first drive shaft means and said leg support means; and (e) the operation of said first and second power means is controlled by programmable computer means.

BRIEF DESCRIPTION OF THE DRAWINGS

The invention will be further understood from the following description and drawings of preferred embodiments of the present invention wherein equivalent structures are numbered the same, the various parts of the device are not drawn to scale, and wherein.

DETAILED DESCRIPTION OF THE DRAWINGS

Figure 1:
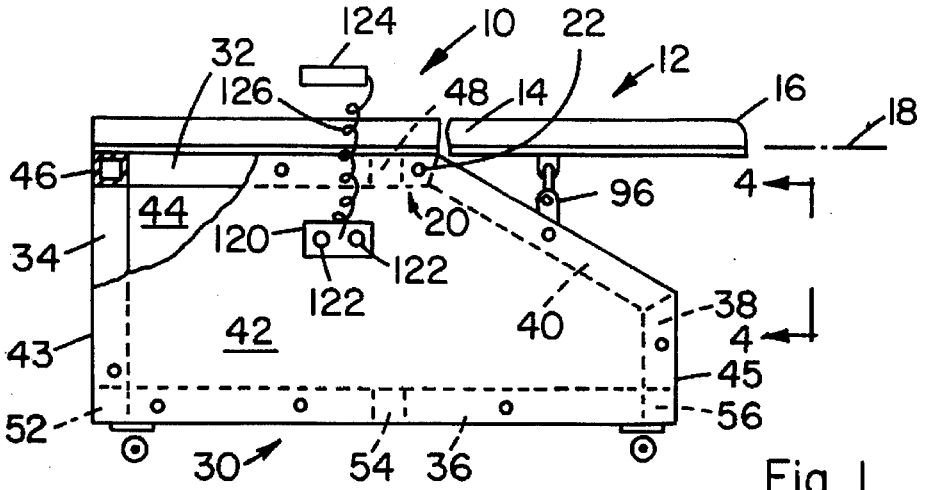
FIG. 1 is a side view of the present device with portions broken away for clarity.
Figure 2:
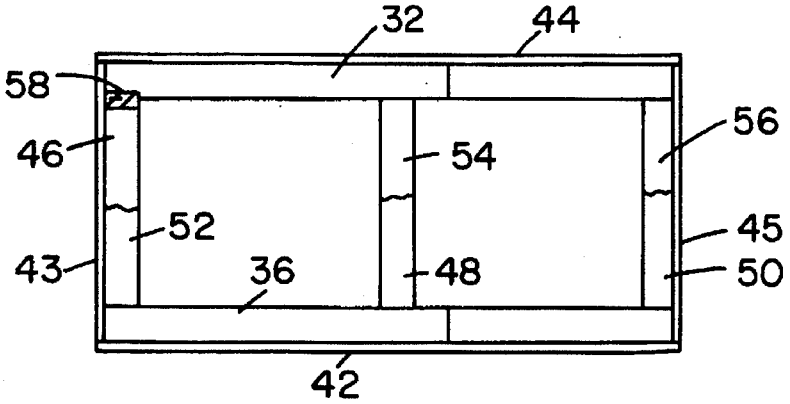
FIG. 2 is a top view of one useful embodiment of a frame construction for the body support means with portions broken away for clarity.

Referring to the drawings and with particular reference to the claims hereof, the present device comprises body support means 10, at least one leg support means 12 having a proximal end 14, a distal end 16 and a longitudinal rest axis 18, hinge means 20 on said body support means connecting the proximal end of said leg support means 12 to said body support means, said hinge means having two axes of rotation 22 and 24 oriented at substantially right angles to each other, first and second power means 26 and 28 on said device associated with said hinge means for rotating the same and said leg support means independently and respectively about each of said two axes of rotation either simultaneously or in tandem, the tandem rotation being operative to selectively describe a plane or a curved surface with said leg support means 12.

Referring to FIG. 1, the body support means generally designated 10 includes a base generally designated 30 and, in the embodiment shown, comprises a frame means such as having interconnected skeletal segments 32, 34, 36, 38, 40 for each side 42 and 44, lateral top segments 46, 48 and 50, and lateral floor segments 52, 54 and 56. All of these segments are preferably of rectangular aluminum tubing and welded at their appropriate junctures as shown at 58 to provide a strong but light-weight structure. This frame means may be provided with internal supporting structures such as motor mounting plates 60 and 62 on which the motors 26 and 28 and the other components of the hinge means 20 are mounted. The numbers, shapes, configurations and attachments of these internal supporting structures, to the frame means will be varied depending on the types of hinge means, power means and frame means being employed.

Figure 4:
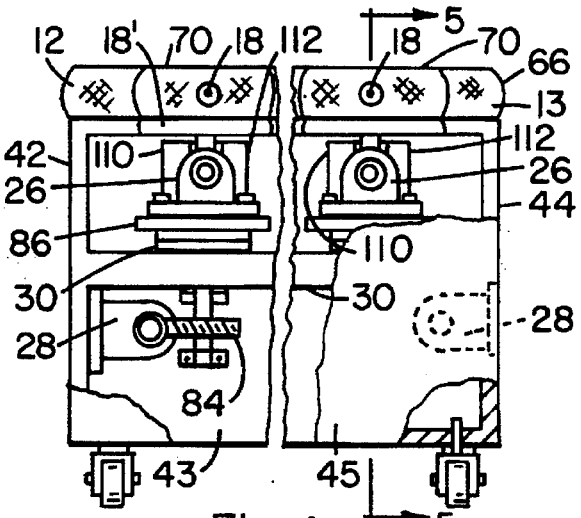
FIG. 4 is an end view of the device taken in the direction of arrow 4 in FIG. 1 with portions of the end wall of the body support means and other structure broken away for clarity.
Figure 8:
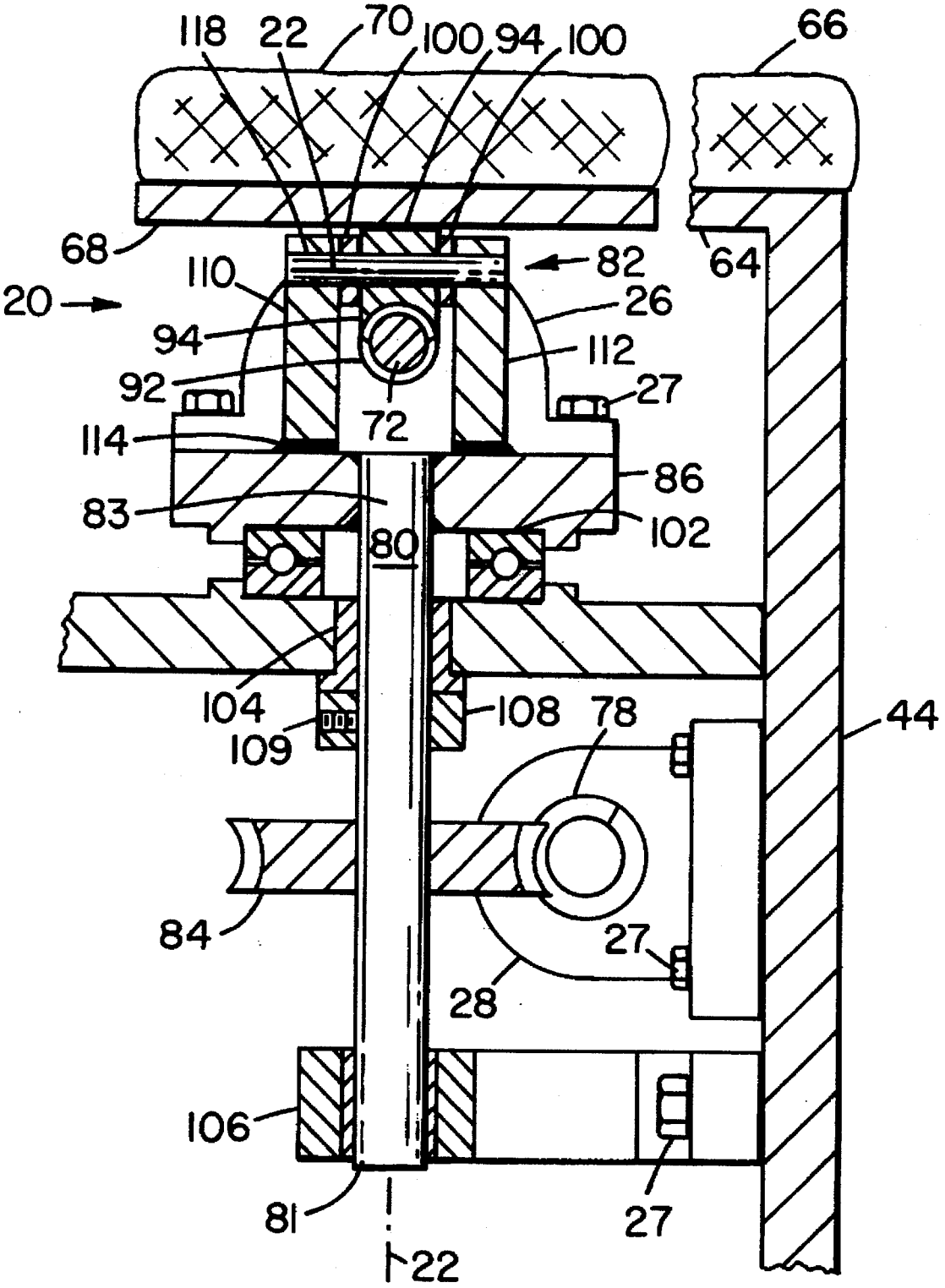
FIG. 8 is a cross-sectional view taken along line 8—8 of FIG. 5 in the direction of the arrows.

The top portion of the body support means preferably comprises a strong flat foundation 64 of metal, wood, or the like on which a cushion 66 is affixed for comfort of the patient. The leg support means 12 preferably comprises a metal bed 68 of any desired contour, e.g., flat or cradle configured in cross-section, on which preferably is affixed a cushion 70 for comfort of the patient. The sides 42, 44 and ends 43, 45 of the body support are preferably covered with fiberboard or the like and cushioned vinyl in known manner for providing a more safe and pleasing exterior. As shown in FIGS. 4 and 8 of the drawings, the sides of the body support may be of sufficiently sturdy metal plate-like construction to support the power means and other internal components.

Figure 5:
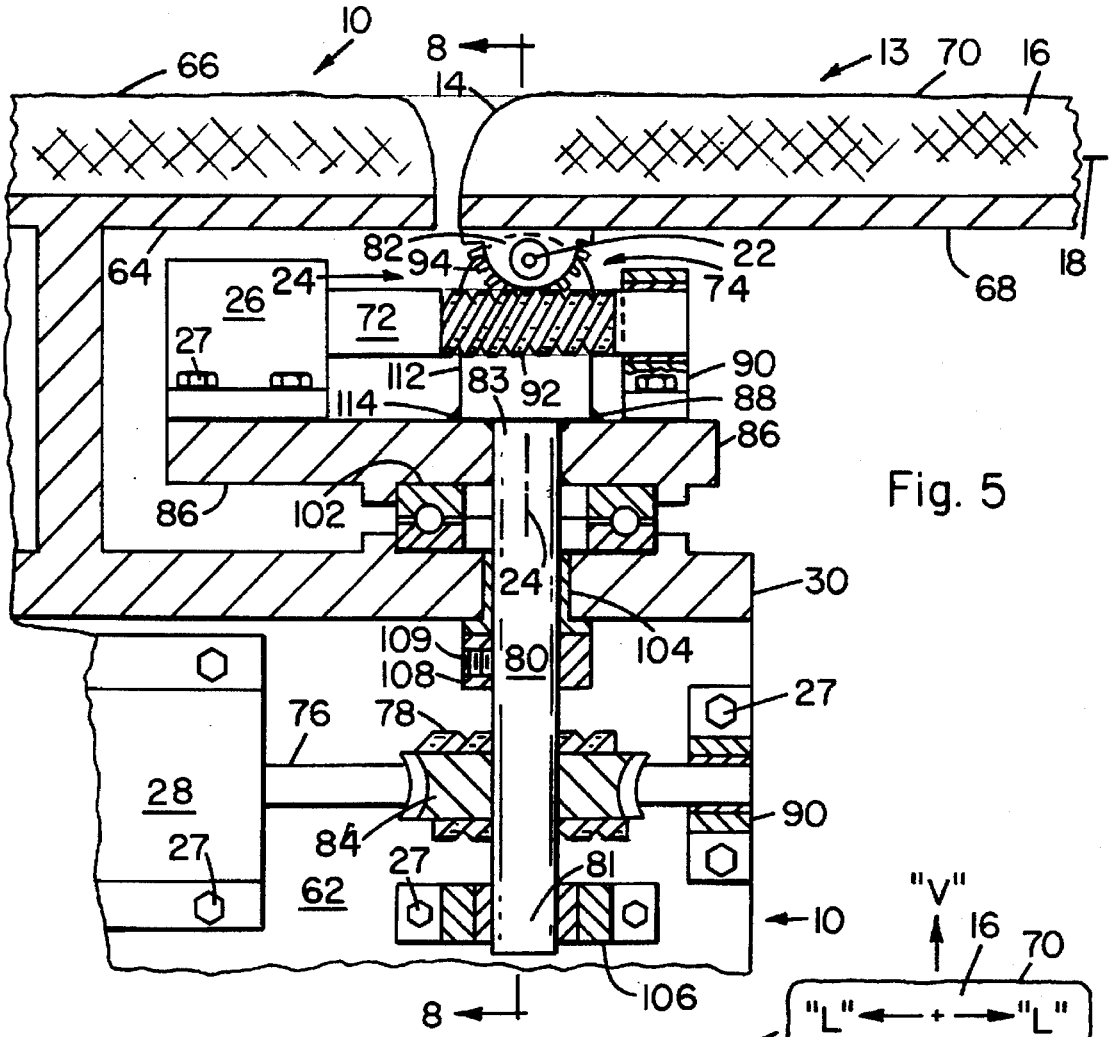
FIG. 5 is an enlarged cross-sectional view of the device taken along line 5—5 of FIG. 4 in the direction of the arrows.
Figure 7:
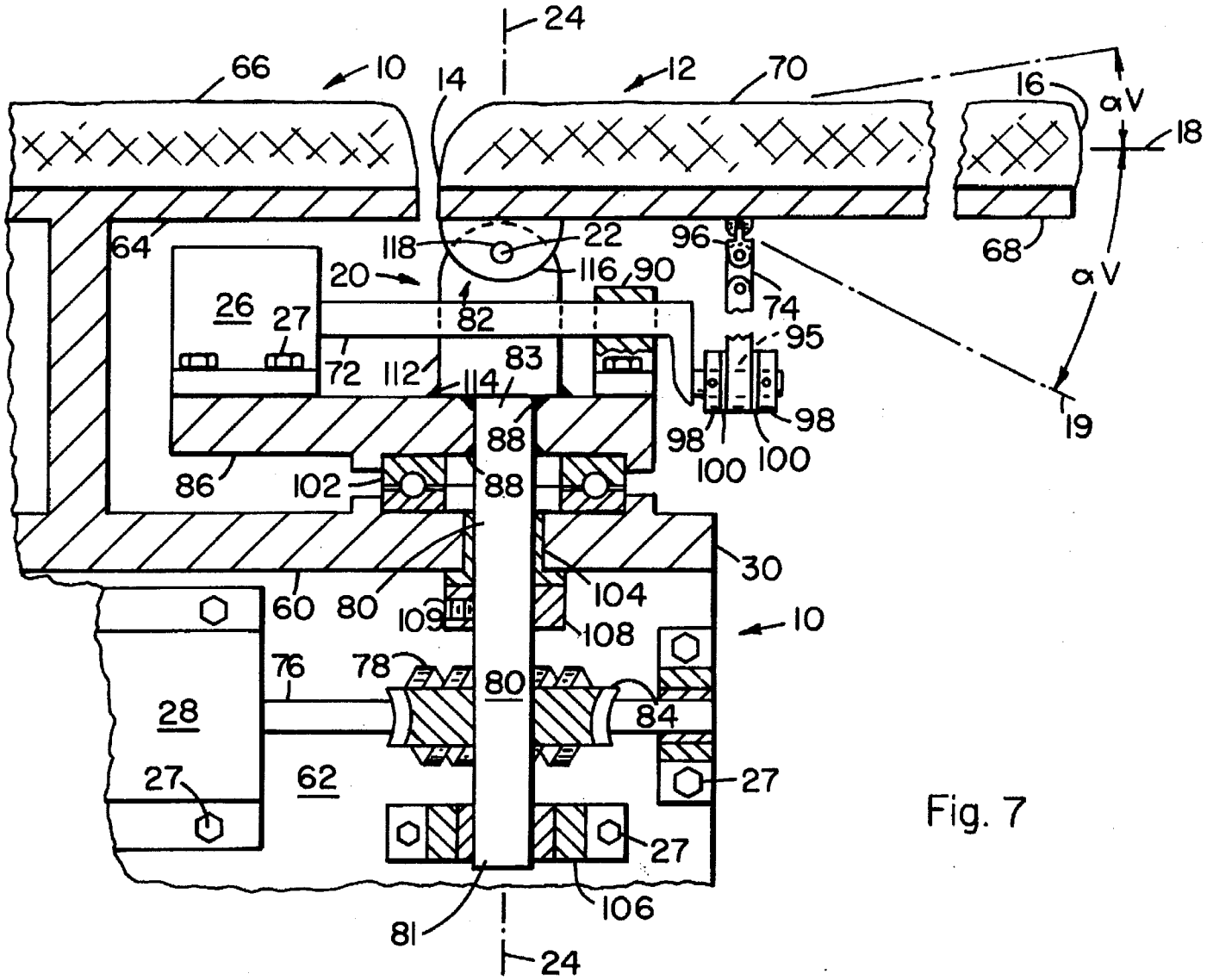
FIG. 7 is an enlarged cross-sectional view as in FIG. 5 showing a variation of the linkage means for producing the vertical motion of the leg support means.

The hinge means 20 as shown in the drawings in preferred forms is a convenient and compact compound structure, and with reference to the two embodiments of FIGS. 5 and 7 comprises first power or motor means 26 having first shaft means 72 connected to linkage means 74 comprising elements 92, 94, 82 and 118, which linkage means is connected to said leg support means 12, end second power or motor means 28 having second drive shaft means 76 provided with first gear means 78, hinge pin or shaft means 80 pivotally mounted on said body support means to provide one of lateral said axes of rotation 24, said hinge pin means having a pivotal connection 82 to said leg support means to provide the other of said axes of rotation 22, and second gear means 84 on said hinge pin means engaging said first gear means 78 for rotating said hinge pin means by said second motor means.

In the above compact form of hinge means 20, motors 26 and 28 preferably are electrical and provided with sufficient reduction gearing to give substantially vertical and lateral oscillation cycles respectively to said leg support means 12, each with a period of, e.g., anywhere of from about one minute or more to about one second or less. It is noted that the term "vertical" as used herein means that the distal end of the leg support moves in an up-down arc which has a vertical distance component, i.e., a chord. The term "lateral" as used herein similarly means that the swing arc of the distal end of the leg support has a distance component which also can be measured as the chord of the swing arc. Each motor may also be of the variable speed type to give essentially a full range of cycle periods over a wide period range.

In the embodiment of FIGS. 5 and 7, motor 26 is conveniently mounted by bolts 27 or the like on a platform 86 to which hinge pin means 80 is welded or otherwise affixed as at 88 and 114. A pillow block 90 or other support bearing means for shaft means 72 is also secured to platform 86. With reference to FIG. 5, the linkage means 74 is integral with and embodied in the worm 92 and worm wheel segment 94 of a worm gear. Segment 94 is preferably welded to bed 68 to provide a sturdy pivoting structure. In FIG. 7, linkage means 74 is in the form of a connecting rod rotatably mounted on the throw journal 95 of crankpin or crankshaft 72. This connecting rod is preferably provided with a compound universal joint 96 or the like to allow full freedom of motion of the leg support means through its cycle, and is conveniently positioned and held in place on the journal by means of lock collars 98 and bearing washers 100.

Platform 86 is preferably mounted on base 30 by a thrust bearing 102 or equivalent, through which hinge pin 80 passes. Bearing 104 in base 30 and bearing means such as pillow block 106 mounted on mounting plate means 62 of base 30 provide a sturdy support for the hinge pin. A lock collar 108 affixed to hinge pin 80 by set screw 109 maintains the proper vertical position of platform 86. A pair of spaced pivot pin mounts or coupling segments 110 and 112 are welded to platform 86 as at 114 and provide a clevis for receiving wheel segment 94 of FIG. 5 or mounting segment 116 of FIG. 7. Pivot pin 118 is mounted through suitable apertures in said mounts and segment to pivotally secure bed 68 to the hinge means 20, and in turn, to base 30 and body support means 10.

The power means 26 and 28 as aforesaid are preferably gear reduced electric motors and also preferably are each connected into a computer controlled electrical power source which can operate the motors to give the desired linear or tandem arcuate motion of the desired cycle period to the leg support means. The computer can be of the microprocessor type to which desired operating information can be fed or changed by a trained technician or trained patient. A control panel such 120 having, e.g., any desired number of dial type control knobs such as 122 for inputting the computer is mounted on the side of the body support means, and preferably, an on/off switch 124 on extension cord 126 provides a convenient means for the patient to control the machine, particularly in an emergency. Typically such manually operable knobs can input such control instructions as speed or cycle period, distance of leg support movement, and direction or path to be followed by the leg support. It is noted that switch 124 may also contain the programming circuitry and electronic switches whereby the patient, without moving from the support means, can alter the path of motion of the leg support means as he desires.

While they are not preferred, other types of power means such as double acting hydraulic cylinders, pulley-belt, tooth pulley chain, or the like can be used in place of the worm gearing. Such alternative power means however do not readily and conveniently provide the required accuracy and control of the desired leg support motion, particularly where serious and sensitive tissue repair is involved. A more suitable alternative power means is the motorized screw jack type 128 as shown in FIG. 11 and comprising a cylinder nut 130 pivotally attached by a compound clevis type joint or equivalent 134 to bed 68 and threadedly receiving shaft 136 of electrical screw motor 138 which is affixed to mounting plate 140 by machine bolts 142.

Figure 11:
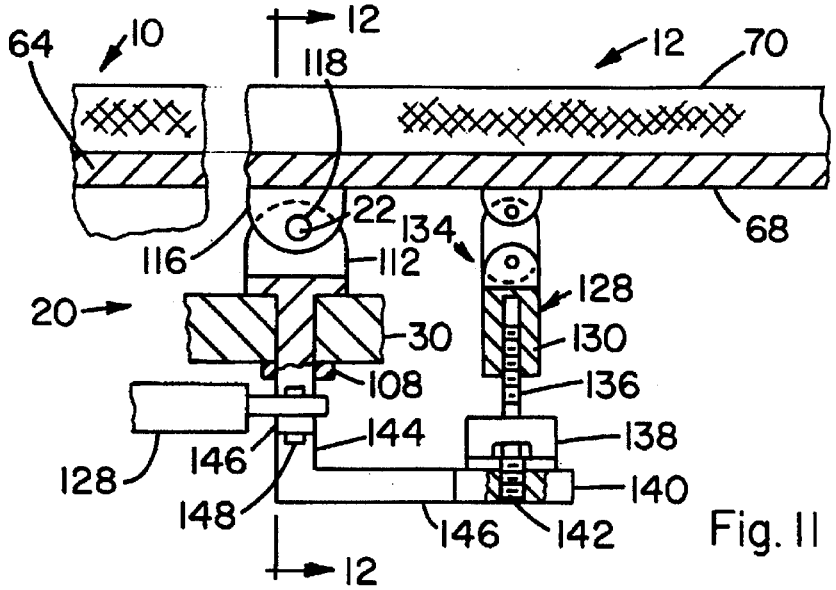
FIG. 11 is a cross-sectional view as in FIG. 7 showing a variation of the hinge means, power means and linkage means.
Figure 12:
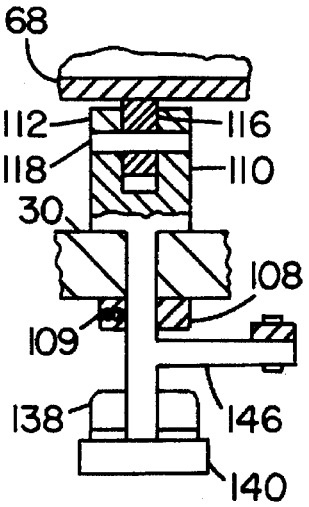
FIG. 12 is a cross-sectional view taken generally along line 12—12 of FIG. 11 in the direction of the arrows.

In the embodiments of FIGS. 11 and 12, the hinge pin or shaft 144 is the equivalent of hinge pin 80 and is provided with a crank arm or platform 146 to which plate 140 is affixed at the lower section 81 thereof. The power means for rotating this crank arm and in turn pin 144, screw jack 128 and leg support 12 is another motorized screw jack 128 pivotally secured to crank arm or platform 146 by pivot pin 148 and similarly pivotally mounted at its other end to a fixed portion of body support means 10. These screw jacks as well as the other power means disclosed herein are, of course, operated by reversible motors or their equivalents.

Figure 6:
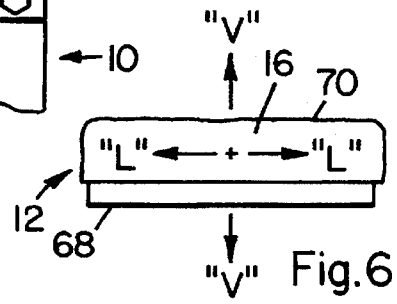
FIG. 6 is a front end view of a leg support means substantially showing, with the leg support means in the rest or neutral position, the relative positions of the vertical, lateral and rest axes.
Figure 3:
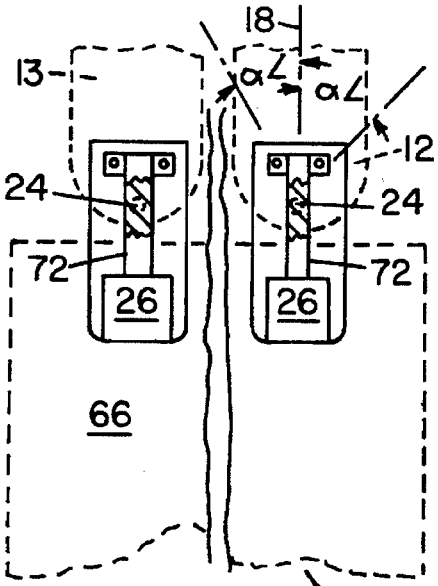
FIG. 3 is a top elevational view of the device of FIG. 1 showing the general layout of the two leg support means mounted on body support means with the leg support means and body support means shown in dotted outline.

The dimensions of the worm gearing and crankpin of FIGS. 5 and 7 may, of course, be varied, however, with reference to the net vertical "V" and lateral "L" directions and distances designated "αV" and "αL" in which the leg support means 12 as shown in the drawings, particularly FIGS. 3, 6, and 7, can move, the dimensions should be such as to give an angular moment to axis 18 of at least up to about 40 degrees and preferably up to about 30 degrees with respect to its rest or starting axis. It is noted that in FIG. 7, the crankpin 72 has been rotated to a position whereby journal 95 is in its downmost position and rest axis 18 has been oriented downwardly to an attitude 19. It is noted that the rest axis or starting point 18 for the leg movement may be translated somewhat, e.g., as to 18, in order to more suitably accommodate the comfort or medical needs of certain patients as they are initially placed or assume a position on the body support.

Figure 9:
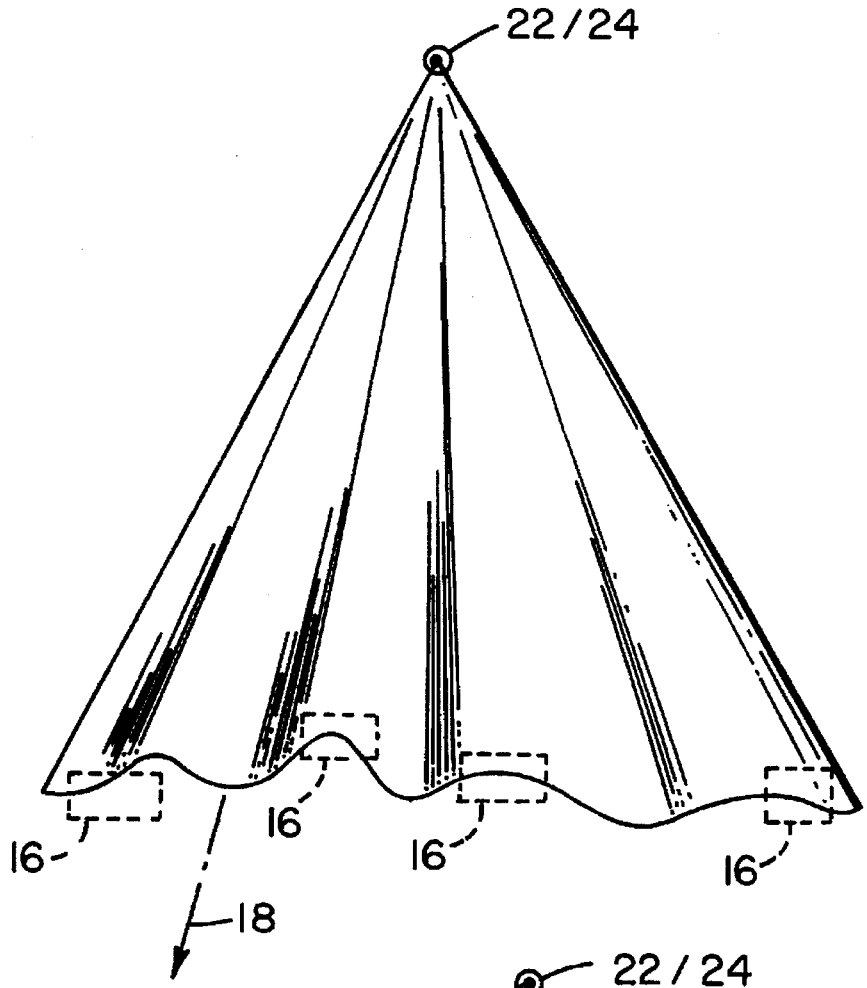
FIG. 9 is a substantially frontal isometric view of an irregularly curved surface capable of being described by movement of the leg support means in accordance with the present invention.
Figure 10:
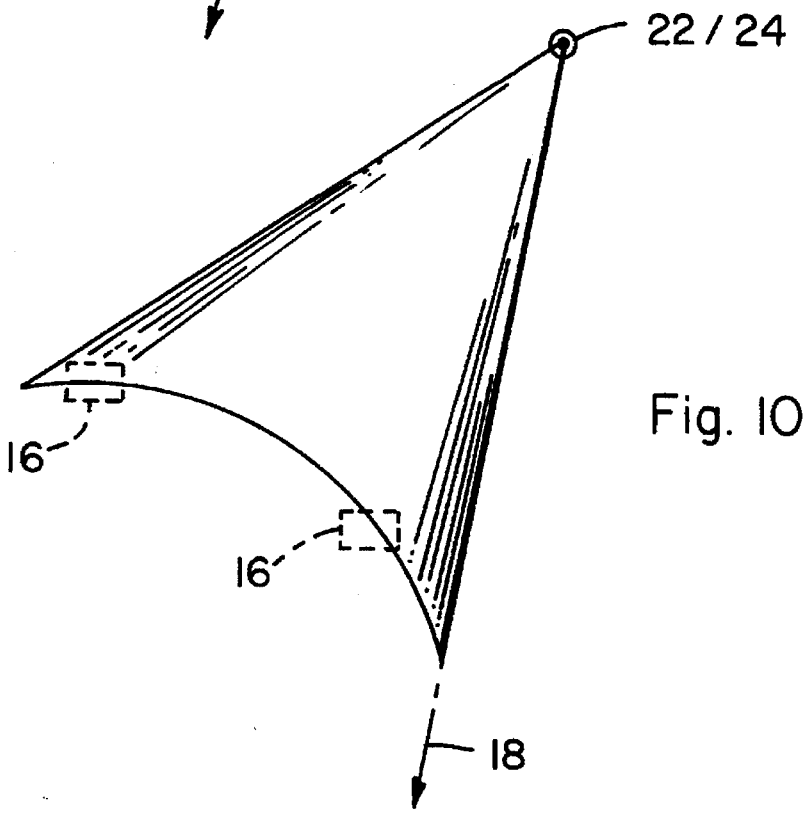
FIG. 10 is a view as in FIG. 9 of a substantially uniformly arched path or surface of motion of the leg support means made possible by the present device.

Shown in FIGS. 9 and 10 are two exemplary paths of motion through which the present apparatus can move the leg, the dotted rectangles representing the distal end 16 of a leg support means and depicting the position thereof at several points of its travel.

The invention has been described in detail with particular reference to preferred embodiments thereof, but it will be understood that variations and modifications will be effected within the spirit and scope of the invention.

I claim:

1. A passive body-motion generating device particularly adapted for moving a patient's legs independently of each other through natural hip joint articulation, said device comprising body support means, a pair of leg support means each having a proximal end, a distal end and a longitudinal rest axis, separate, independently operable hinge means pivotally connecting the proximal end of each said leg support means to said body support means, each said hinge means having first and second axes of rotation oriented at substantially right angles to each other, said first axis of rotation affording a generally vertical pivotal action to the leg support means, said second axis of rotation affording a generally lateral pivotal action to the leg support means, and independently operable first and second power means on said device associated with each said hinge means for independently operating the same and moving the leg support means independently about each of its said two axes of rotation either one at a time or in tandem, the tandem rotation about said two axes being operative to selectively describe a plane or a curved surface with the leg support means, wherein said first power means has first drive shaft means connected to linkage means which is connected to the leg support means, and said second power means has second drive shaft means provided with first gear means, hinge pin means pivotally mounted on said body support means and having a pivotal connection to the leg support means to provide said generally vertical pivotal action thereto, and second gear means on said hinge pin means engaging said first gear means for rotating said hinge pin means by said second power means to provide said generally lateral pivotal action to the leg support means.

2. The device of claim, 1 wherein said first and second gear means comprise cooperating worm gear components.

3. The device of claim 1 wherein said first drive shaft means comprises crankpin means.

4. The device of claim 1 wherein said linkage means comprises cooperating worm gear components on said first drive shaft means and said leg support means.

5. The device of claim 2 wherein said linkage means comprises cooperating worm gear components on said first drive shaft means and said leg support means.

6. The device of claim 1 wherein said first power means is mounted on platform means, and wherein said platform means is affixed to said hinge pin means and is rotatable thereby.

7. The device of claim 6 wherein said first power means, platform means, linkage means, hinge pin means and leg support means are all interconnected and rotatable in unison about said second axis which is oriented substantially vertically.

8. The device of claim 1 wherein said first and second power means comprises motorized screw-jack means.

9. The device of claim 1 wherein hinge pin means is pivotally mounted on said body support means to provide said second axis of rotation, said hinge pin means having a pivotal connection to the proximal end portion of said leg support means to provide said first axis of rotation, said first power means comprises first screw-jack means mounted on said hinge pin means and having first drive shaft means connected to first linkage means which is connected to the leg support means, and said second power means comprises second screw-jack means mounted on said body support means and having second drive shaft means connected to said hinge pin means for simultaneously rotating said hinge pin means, said first screw-jack means, and said leg support means.

* * * * *